US010192404B2

(12) United States Patent
Park

(10) Patent No.: US 10,192,404 B2
(45) Date of Patent: Jan. 29, 2019

(54) DEVICE FOR MANAGING A PROGRESSIVE JACKPOT

(71) Applicant: John Park, Los Angeles, CA (US)

(72) Inventor: John Park, Los Angeles, CA (US)

( * ) Notice: Subject to any disclaimer, the term of this patent is extended or adjusted under 35 U.S.C. 154(b) by 21 days.

(21) Appl. No.: 15/099,374

(22) Filed: Apr. 14, 2016

(65) Prior Publication Data

US 2016/0358421 A1 Dec. 8, 2016

(51) Int. Cl.
*A63F 9/24* (2006.01)
*G07F 17/32* (2006.01)

(52) U.S. Cl.
CPC ..... *G07F 17/3258* (2013.01); *G07F 17/3225* (2013.01); *G07F 17/3293* (2013.01)

(58) Field of Classification Search
CPC ..... G07F 17/3258; G07F 17/3225; G07F 17/3293
USPC ..... 463/12
See application file for complete search history.

(56) References Cited

U.S. PATENT DOCUMENTS

2007/0184898 A1* 8/2007 Miller ..... G07D 9/002 463/29
2009/0131151 A1* 5/2009 Harris ..... G07F 17/32 463/22
2010/0087246 A1* 4/2010 Ward ..... G07F 17/3258 463/27
2012/0098197 A1 4/2012 Smith et al.
2012/0252564 A1* 10/2012 Moore ..... G07F 17/322 463/25
2015/0312517 A1 10/2015 Hoyt et al.
2016/0055720 A1 2/2016 Oles et al.
2016/0063814 A1 3/2016 Vancura et al.

* cited by examiner

*Primary Examiner* — Jay Trent Liddle
*Assistant Examiner* — Ryan Hsu
(74) *Attorney, Agent, or Firm* — Fountainhead Law Group P.C.

(57) ABSTRACT

A jackpot wager that a player may qualify for as long as the player is playing on any of the designated games and places a jackpot wager. A player may participate in the jackpot while playing Blackjack, Pai Gow Poker or Baccarat and may either win a portion, percentage or the entire jackpot based on the qualifying hand dealt. The jackpot is not limited to the individual premise and may encompass multiple premises. The jackpot is not limited to the games listed but may be attached to all games to hands similar in frequency of being dealt. Card games are often now played in an electronic format online or utilizing an electronic gaming cabinet or video poker type machine. The present invention relates to a game that can be played both in the traditional format using a deck of cards or in an electronic format.

14 Claims, 7 Drawing Sheets

Table Layout 10

Table Layout 10

DEVICE FOR MANAGING A PROGRESSIVE JACKPOT

CROSS REFERENCE TO RELATED APPLICATIONS

Not applicable.

BACKGROUND

The present invention relates to gaming, and in particular, to managing a progressive jackpot.

Unless otherwise indicated herein, the approaches described in this section are not prior art to the claims in this application and are not admitted to be prior art by inclusion in this section.

Blackjack, also known as twenty-one, is a widely played casino game. Blackjack is a comparing card game between a player and dealer, meaning that players compete against the dealer but not against any other players. It is played with one or more decks of 52 cards, or with an augmented deck of cards containing any number of cards that may even include jokers. The deck is made up of primarily four different suits, hearts, spades, diamonds, and clubs. The object of the game is to beat the dealer, which can be done in a number of ways, get 21 points on the player's first two cards (called a blackjack), without a dealer blackjack; reach a final score higher than the dealer without exceeding 21; or let the dealer draw additional cards until the dealers hand exceeds 21.

The player or players are dealt an initial two-card hand and add together the value of their cards. Face cards kings, queens, and jacks are counted as ten points. A player and the dealer can count his or her own ace as 1 point or 11 points. All other cards are counted as the numeric value shown on the card. After receiving their initial two cards, players have the option of getting a hit, or taking an additional card. In a given round, the player or the dealer wins by having a score of 21 or by having the highest score that is less than 21. Scoring higher than 21, called busting that results in a loss. A player may win by having any final score equal to or less than 21 if the dealer busts. If a player holds an ace valued as 11, the hand is called soft, meaning that the player cannot go bust by taking an additional card; 11 plus the value of any other card will always be less than or equal to 21. Otherwise, the hand is hard. The dealer has to take hits until his or her cards total 17 or more points. If the player's and dealer's hands tie, it is called a push and the player typically does not win or lose money on that hand.

Many rule variations of Blackjack exist along with side wagers or jackpots. A jackpot is a side wager that wins when a particular hand is dealt suited or unsuited. Example of a Blackjack jackpot when using multiple decks is when the player is dealt two seven of hearts, takes a hit (receiving another card), and receives another seven of hearts for a total of 21 made using three seven of hearts; and in the same hand the dealer is dealt two eight of spades and draws a third eight of spades (since the dealer would be required to hit the hand because the dealer must hit to 17).

Pai Gow Poker is another widely played casino game. The cards are shuffled, and then dealt to the table in seven face-down piles of seven cards per pile, with four cards left over. Betting positions are assigned a number from 1 to 7, starting with whichever player is acting as banker that hand, and counting counter-clockwise around the table. A number from 1 to 7 is randomly chosen either electronically or manually with dice, then the deal begins with the corresponding position and proceeds counter-clockwise. One common way of using dice to determine the dealer starting number is to roll three six-sided dice, and then count betting spots clockwise from the first position until the number on the dice is reached. The player forms a two card hand and a five card (better) hand using standard poker rankings. The joker plays as completely wild or used to complete a straight or flush if possible; otherwise it is an ace.

There are a number of variations of Pai Gow Poker that are popular in casinos today. Pai Gow Mania was the first variation to be created; it allows for two side bets instead of the traditional one side bet per hand. Fortune Pai Gow is another variation; it allows players to make a side bet on a poker hand ranking of trips or better. This is one of the most popular variations. Similar to Fortune Pai Gow, is Emperor's Challenge, which also allows a side bet on a 7 card pai gow (no hand). The final variation of the game developed was Pai Gow Progressive, which is the addition of a progressive jackpot to the pai gow table. This jackpot is the combined of $1 side bets placed by players during the play.

In Baccarat, cards have a point value: Cards 2-9 are worth their face value in points; 10s, Js, Qs and Ks have no point value i.e. are worth zero; Aces are worth 1 point; and jokers are not used in the game of Baccarat. Hands are valued according to the rightmost digit of the sum of their constituent cards: For example, a hand consisting of 2 and 3 is worth 5, but a hand consisting of 6 and 7 is worth 3 (i.e. the 3 being the rightmost digit in the combined points total: 13). The highest possible hand value in baccarat is 9.

There are several variants of Baccarat and Baccarat jackpots. For example, the Dragon side bet for EZ Baccarat wins and pays 40-to-1 if the dealer's three-card total of 7 beats the player, otherwise the bet loses.

Currently each type of casino wagering game has its own exclusive jackpot, meaning a Blackjack jackpot is separate from a Pai Gow Poker jackpot etc.

SUMMARY

Given the above, embodiments are directed toward improving the player experience regarding jackpots.

Instead of each game having a separate jackpot, embodiments resolve this problem by linking the different type of casino games into one central jackpot in addition to each game exclusive jackpots within a single premise or multiple premises, creating higher jackpots and excitement.

It is therefore an object of embodiments to qualify for the jackpot by placing a jackpot wager and playing Blackjack (or Blackjack type games) and the designated hand or hands are dealt.

It is another object of embodiments to qualify for the jackpot by placing a jackpot wager and playing Baccarat (or Baccarat type games) and the designated hand or hands are dealt.

It is another object of embodiments to qualify for the jackpot by placing a jackpot wager and playing Pai Gow Poker (or Pai Gow Poker type games) and the designated hand or hands are dealt.

It is another object of embodiments to not limit the participation in the jackpot to just the designated tables provided (Blackjack, Baccarat, Pai Gow Poker, et.c) but to include any casino card game with qualifying hands with similar frequencies of occurrence or odds of being dealt, so it may be added to three card using a combination of both the dealers and players hands. Example games include Ultimate Texas Hold-em, War, Texas Hold-em, Seven Card Stud, etc.

It is another object of embodiments to not limit the participation of the jackpot to just compare games where the players hand is compared to the dealers hand, but to encompass all games, including games where the player's hand is compared against other players' hands (e.g., Poker, Texas Hold-em, etc.), as long as the player places the jackpot wager.

Embodiments relate to casino wagering games and, more particularly, to adding a jackpot wager whose participation may be done from several different type of wagering games, e.g., Blackjack, Baccarat, Pai Gow Poker, etc. A jackpot wager in Blackjack games that qualifies for a portion the jackpot when the dealer's hand consists of three unsuited eight cards and receives either a fixed amount or percentage of the jackpot; to qualify for a greater fixed amount or percentage, the dealer's hand must consist of three red eight cards; and to receive 100% of the jackpot the dealer's hand must consist of three eight cards all in diamonds.

When playing Baccarat, to qualify for a portion of the jackpot the banker hand must win with a three card point total of 7, and the banker's hand and player's hand must consist of all red cards to receive a fixed amount or percentage of the jackpot; and to receive 100% of the jackpot the banker's hand and the player's hand must consist of all in diamonds (also with the banker winning with the three card total of 7).

When playing Pai Gow Poker, to qualify for a portion of the jackpot the dealer's hand must consist of a seven card diamond flush with the joker card, and to receive 100% of the jackpot the dealer's hand must consist of a seven card flush in diamonds without the joker card.

According to an embodiment, a gaming system includes a housing, a display device, a network interface, at least one processor, and at least one memory device. The memory device stores a plurality of instructions that, when executed by the at least one processor, cause the at least one processor to operate with the display device and the network interface to receive, from a server, a progressive jackpot amount, wherein the progressive jackpot amount is associated with a plurality of gaming systems that includes the gaming system; to display the progressive jackpot amount for a current game; to receive chip information that indicates a jackpot wager for the current game, wherein the server updates the progressive jackpot amount according to the jackpot wager; to receive card information that indicates a game outcome of the current game; when the game outcome corresponds to a jackpot outcome, to display a jackpot amount, wherein the server reduces the progressive jackpot amount by the jackpot amount; and when the game outcome does not correspond to the jackpot outcome, to display the progressive jackpot amount for a next game.

The gaming system may further include a radio frequency identification (RFID) chip reader that generates the chip information by detecting gaming chips on a gaming table, and an instrumented card shoe that generates the card information by detecting gaming cards removed from the instrumented card shoe, wherein the gaming cards are played on the gaming table.

According to an embodiment, a progressive jackpot system includes a server and a plurality of gaming systems. Each of the gaming systems is as described above. In this manner, the progressive jackpot is associated with all of the gaming systems. The gaming systems are associated with a plurality of gaming tables, wherein the plurality of gaming tables are associated with at least two types of casino games.

According to an embodiment, a method manages a progressive jackpot. The method includes providing a gaming system having a housing, a display device, a network interface, at least one processor, and at least one memory device, wherein the at least one memory device stores a plurality of instructions that, when executed by the at least one processor, cause the at least one processor to operate with the display device and the network interface. The method further includes receiving, by the gaming system from a server, a progressive jackpot amount, wherein the progressive jackpot amount is associated with a plurality of gaming systems that includes the gaming system. The method further includes displaying, by the gaming system, the progressive jackpot amount for a current game. The method further includes receiving, by the gaming system, chip information that indicates a jackpot wager for the current game, wherein the server updates the progressive jackpot amount according to the jackpot wager. The method further includes receiving, by the gaming system, card information that indicates a game outcome of the current game. When the game outcome corresponds to a jackpot outcome, the method further includes displaying a jackpot amount, wherein the server reduces the progressive jackpot amount by the jackpot amount. When the game outcome does not correspond to the jackpot outcome, the method further includes displaying the progressive jackpot amount for a next game.

The following detailed description and accompanying drawings provide a further understanding of the nature and advantages of embodiments of the present invention.

DETAILED DESCRIPTION

Described herein are techniques for managing a progressive jackpot. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

In the following description, various methods, processes and procedures are detailed. Although particular steps may be described in a certain order, such order is mainly for convenience and clarity. A particular step may be repeated more than once, may occur before or after other steps (even if those steps are otherwise described in another order), and may occur in parallel with other steps. A second step is required to follow a first step only when the first step must be completed before the second step is begun. Such a situation will be specifically pointed out when not clear from the context.

In this document, the terms "and", "or" and "and/or" are used. Such terms are to be read as having an inclusive meaning. For example, "A and B" may mean at least the following: "both A and B", "at least both A and B". As another example, "A or B" may mean at least the following: "at least A", "at least B", "both A and B", "at least both A and B". As another example, "A and/or B" may mean at least the following: "A and B", "A or B". When an exclusive-or is intended, such will be specifically noted (e.g., "either A or B", "at most one of A and B").

Figure 1:
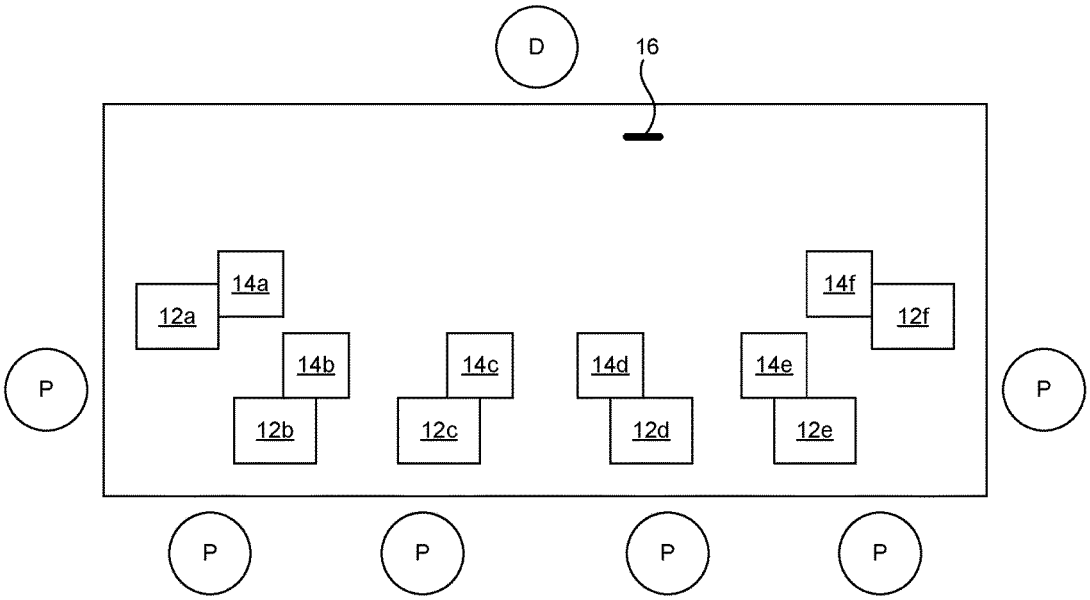
FIG. 1 is a detail view of a table layout.

FIG. 1 is a detail view of a table layout 10. The table layout 10 may be placed on a standard gaming table for providing a gaming location for one or more players. The table layout 10 includes a number of base wagering areas 12 (six shown: 12a, 12b, 12c, 12d, 12e and 12f) and a number of jackpot wagering areas 14 (six shown: 14a, 14b, 14c, 14d, 14e and 14f). A number of players "P" may place in the base wagering areas 12 bets to be made in the standard game being played on the gaming table, and the players may place in the jackpot wagering areas 14 bets to be made for the jackpot. A dealer "D" may manage the game at the gaming table. Atop the gaming table is also a slot 16 for the collection of the chips of the losing jackpot wagers.

Figure 2:
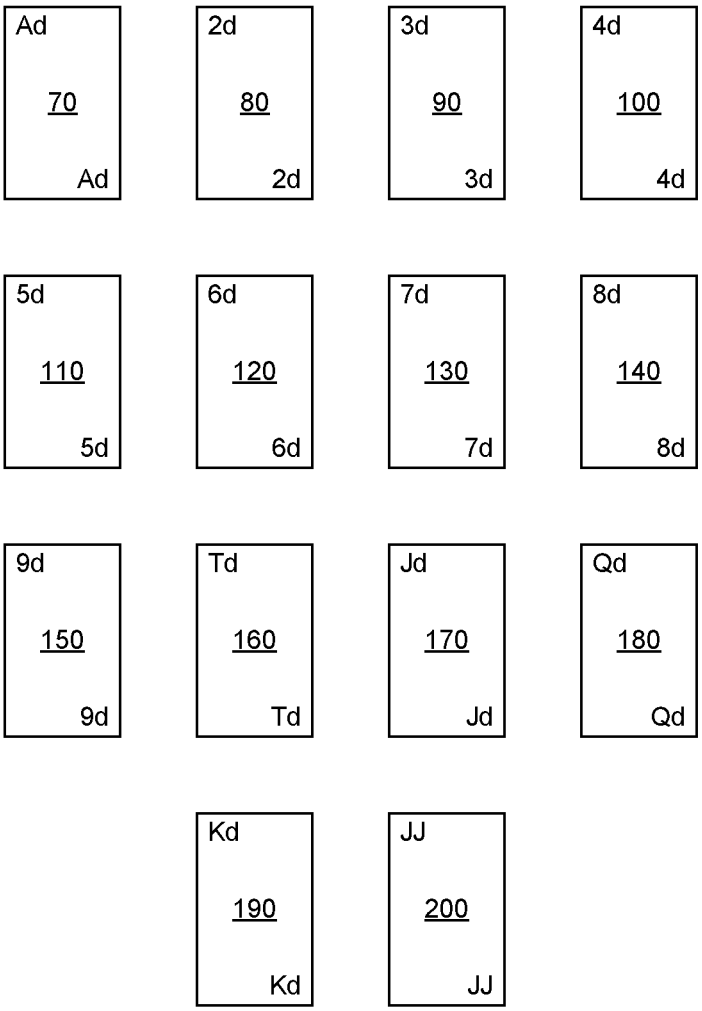
FIG. 2 is a detail view of a cards used in a standard deck of cards along with a joker card in games that utilize a joker in order to qualify for the jackpot.

FIG. 2 is a detail view of a cards used in a standard deck of cards along with a joker card 200 in games that utilize a joker in order to qualify for the jackpot. A standard deck of cards is used and contains an ace "A" card 70, a deuce "2" card 80, a three "3" card 90, a four "4" card 100, a five "5" card 110, a six "6" card 120, a seven "7" card 130, an eight "8" card 140, a nine "9" card 150, a ten "T" card 160, a jack "J" card 170, a queen "Q" card 180, a king "K" card 190, and a joker "JJ" card 200 in games that utilize a joker that may be completely wild or to complete straights, or flushes otherwise it is an ace. The deck consists of 4 of each rank of card in four different suits (hearts, spades, clubs and diamonds; diamonds "d" are shown, e.g. "Ad" is the ace of diamonds).

The basic premise of the jackpot wager is to allow a player to play different type of wagering games and combine their exclusive jackpots into one central jackpot. Furthermore, the rules of the current card games are not altered in any way the games will be played under their current rules; all that is added is an additional jackpot wager that wins a portion or the entire jackpot when a designated hand or hands are dealt. In the event there are two or more players wagering on the same hand, the jackpot will be split among the players that wagered on the jackpot; conversely if two players wagered on the same hand but only one player placed a bet on the jackpot wager, then only that player will win the jackpot. The jackpot promotion may be attached to Baccarat, Blackjack, Pai Gow Poker, etc. but is not limited to these games. Other games may be added to the list, and the qualifying predetermined hand or hands for each game may be based on the frequency or occurrence of the hand or hands being dealt.

Furthermore, all rules and procedures for this gaming activity, including but not limited to the following, may be prominently displayed at all times this gaming activity is being offered for play: Eligible games and time periods; qualifying hands and corresponding prize; prize payout structure; the prize amount that may be awarded; any No Purchase Necessary opportunity; any other restrictions that apply to this gaming activity.

The jackpot gaming activity features a progressive jackpot prize. A prize is awarded to players, who have paid the jackpot fee, in any designated game, when the designated dealer has been dealt a qualifying hand. After the hand is confirmed, those players who paid the jackpot fee may receive the posted prize from the progressive jackpot.

When the dealer makes one of the following advertised qualifying hands during the play of an eligible, all players who paid the jackpot fee may be eligible to win their share of the posted jackpot prize amount, according to the payout options, as shown below. Only the hands pre-determined and designated by the Casino are eligible.

An example of how to play and qualify for a portion or the entire jackpot is shown in TABLE 1. Assume that the three designated tables are Blackjack, Pai Gow Poker and Baccarat. The jackpot wager is a progressive jackpot prize. A prize is awarded to players, who have paid the $1 jackpot fee, and the hand is confirmed, those players who paid the jackpot fee may receive the posted prize from the progressive jackpot.

TABLE 1

| Game | Dealer Hand | Payout |
|---|---|---|
| Baccarat | Banker wins with three-card point total of 7 - All red cards | $1000 |
| Baccarat | Banker wins with three-card point total of 7 - All diamond cards | 100% of jackpot |
| Blackjack | Three "8" cards (8-8-8) | $500 |
| Blackjack | Three "8" red cards | $5000 |
| Blackjack | Three "8" diamond cards | 100% of jackpot |
| Pai Gow Poker | Seven card diamond flush (with Joker) | $5000 |
| Pai Gow Poker | Seven card diamond flush (without Joker) | 100% of jackpot |

Another example of the jackpot qualifiers and jackpots is shown in TABLE 2. The games include Baccarat, Blackjack X (a variation on Blackjack with the goal to hit 31), Pal Gow Poker, and Three Card Poker (a variation of poker using three cards).

TABLE 2

| Game | Dealer Hand | Payout |
|---|---|---|
| Baccarat | Banker wins with three-card point total of 7 and all diamond cards | 100% of jackpot |
| Blackjack X | Three "8" diamond cards | |
| Pai Gow Poker | Seven card diamond flush (without Joker) | |
| Three Card Poker | Five card royal diamond flush (that includes any player hand with the dealer hand) | |
| Blackjack X | Three "8" cards | $ 500 |
| Three Card Poker | A-K-Q - All red cards | $ 500 |
| Baccarat | Banker wins with three-card point total of 7 and all red cards | $1000 |
| Blackjack X | Three "8" red cards | $5000 |
| Three Card Poker | A-K-Q - All diamond cards | $5000 |
| Pai Gow Poker | Seven card diamond flush (with Joker) | $5000 |

Another example of the jackpot qualifiers and jackpots is shown in TABLE 3. The example is limited to Poker games (e.g., Texas Hold-em, Omaha, etc.) and instead of using the dealer's hand, the jackpot is determined from the community cards, either all five community cards or just the first three community cards (the "flop").

TABLE 3

| Game | Community Cards | Payout |
|---|---|---|
| Poker | Royal flush (all five cards) | 100% of jackpot |
| Poker | Flush (first three cards) | $5 |

TABLE 3-continued

| Game | Community Cards | Payout |
|---|---|---|
| Poker | Straight (first three cards) | $ 10 |
| Poker | Three of a kind (first three cards) | $ 35 |
| Poker | Straight flush (first three cards) | $ 40 |
| Poker | Mini-royal flush (first three cards) | $300 |

As mentioned above, the contributions (the jackpot fee from each player) from all the games may be combined into a single progressive jackpot. For example, assume the jackpot is $42,000, five players posted the jackpot fee, and the qualifying hand results in a 100% payout. The jackpot is split among the five players for $8,400 each.

The amount of the jackpot fee (e.g., $1) may be increased or decreased as desired. The amounts of the payouts may be increased or decreased as desired.

Additional games to which the jackpot may be applied include EZ Baccarat, EZ Baccarat Panda 8, Pai Gow Poker with Triple Bonus Bets, Texas Hold-em, No Limit Texas Hold-em, Omaha, Omaha High Low Split, and Big O (a variant of Omaha where each player is dealt five cards).

The jackpot prize may be progressive. The jackpot prize may be paid in the form of cash, casino chips, merchandise, trips, poker tournament entries, electronics, or other prizes. The actual progressive jackpot prize amount may depend on the amount the jackpot was originally seeded at, as well as how much time was accumulated in order for the jackpot to increase progressively each day. The jackpot prize may be updated in real time according to chip tracking information acquired at each table.

The Games Jackpots gaming activity utilizes one Jackpot account which may be funded by a $1 jackpot collection which may be dropped in a separate drop box marked as Jackpot.

When a qualifying jackpot hand is made, the jackpot may be re-seeded by Casino.

Electronic Device Implementations

The following figures provide additional details on electronic devices that may be used to manage the progressive jackpot.

Figure 3:
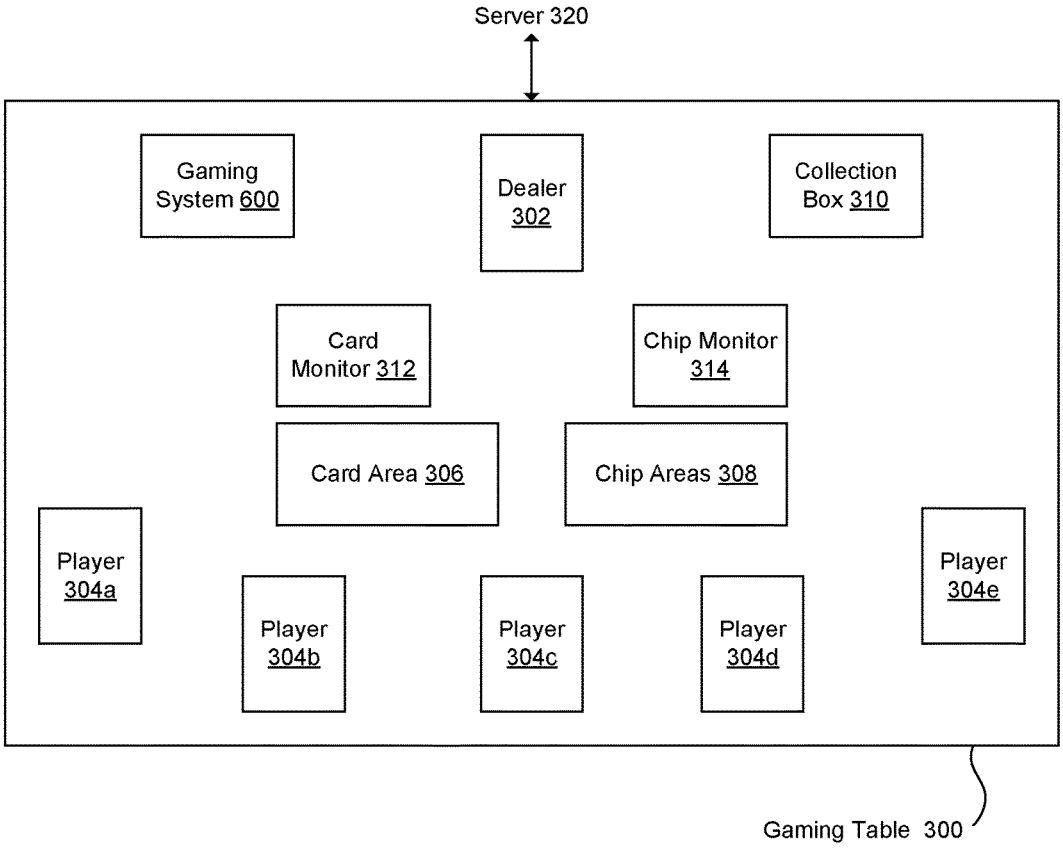
FIG. 3 is a block diagram of a gaming table 300.

FIG. 3 is a block diagram of a gaming table 300. The gaming table 300 includes a number of components and a number of areas or positions, which are not shown to scale. The areas or positions include a dealer position 302, one or more player positions 304 (five shown: 304*a*, 304*b*, 304*c*, 304*d* and 304*e*), a card area 306, and one or more chip areas 308. The components include a collection box 310, a card monitor 312, a chip monitor 314, and a gaming system 600. The gaming table 300 may include additional components and areas or positions, which for brevity are not shown. The components may communicate with a server 320. The server 320 may be located remotely from the gaming table 300 (e.g., in a back office).

The dealer position 302 indicates a position for a dealer or other casino personnel. The player positions 304 indicate positions for one or more players. The card area 306 indicates an area in which cards are played as part of playing a game at the gaming table 300. The chip areas 308 indicate one or more areas in which chips are played as part of playing the game at the gaming table 300. The number and sizes of the chip areas 308 generally correspond to betting locations (e.g., for a player to place a wager in the game), payout locations (e.g., for the dealer to pay out winning bets), or jackpot wager locations (e.g., for a player to place a jackpot wager). For example, in FIG. 1, the base wagering areas 12 and the jackpot wagering areas 14 are chip areas. The areas may be marked for ease of identification by the dealer and players. The areas may be associated with the components, as further discussed below.

The collection box 310 generally serves as a repository for the collection of losing jackpot wagers (e.g., casino chips). Periodically, casino personnel remove the chips from the collection box 310, e.g. to verify the amount collected, to verify or update the progressive jackpot amount, etc. The collection box 310 may interact with the chip monitor 314. For example, the chip monitor 314 may track chips as they pass through a collection slot into the collection box 310.

The card monitor 312 generally monitors the cards played during a game on the gaming table 300. The card monitor 312 may be implemented as an instrumented card shoe. The card monitor 312 may read the rank and suit of cards as they are removed from the card shoe. The card monitor 312 may communicate with the server 320, with the chip monitor 314, or with the gaming system 600. During gameplay, the card monitor 312 may track information such as player performance (e.g., the player does or does not conform to optimal strategy). After the game, the card monitor 312 may interact with the chip monitor 314 to verify that correct payments are made to winning bets, and correct collection of losing bets. For the jackpot, the card monitor 312 may interact with the gaming system 600 to identify that the jackpot criteria have been met (e.g., in Baccarat, the Banker wins with three-card point total of 7 and the Banker and Player have all-red cards).

The chip monitor 314 generally monitors the chips played during a game on the gaming table 300. The chip monitor 314 may be implemented as a radio frequency identification (RFID) system that reads RFID tags embedded in the chips. The chip monitor 314 may be connected to one or more RFID antennas that may be placed at one or more locations on the gaming table 300, referred to as betting locations. For example, each player position 304 may have two betting locations (two chip areas 308), one for placing chips to be wagered during normal gameplay, and another for placing chips to be wagered for the jackpot. The chip monitor 314 may communicate with the collection box 310, with the server 320, with the card monitor 312, or with the gaming system 600. For example, the chip monitor 314 may inform the gaming system 600 that a jackpot wager has been placed by one or more of the players at the gaming table 300. The chip monitor 314 may interact with the card monitor 312 to verify, for a non-jackpot result of the cards, that the dealer has moved the losing chips wagered in the jackpot from the gaming table 300 to the collection box 310. The chip monitor 314 may communicate chip information with the server 320, e.g. to track betting action at the gaming table 300.

The gaming system 600 generally manages the jackpot for the table 300. The gaming system 600 may communicate with the server 320, with the collection box 310, with the card monitor 312, or with the chip monitor 314. The gaming system 600 may transmit to the server 320 information of the amount of chips in the collection box 310, or that the chip monitor 314 has detected a chip being placed into the collection box 310, so that the server 320 may update the progressive jackpot amount. The gaming system 600 may transmit to the server 320 information that the chip monitor 314 has detected that a jackpot wager has been made. The gaming system 600 may receive from the server 320 the current progressive jackpot amount. Further details of the gaming system 600 are given below with reference to FIG. 6.

Figure 4:
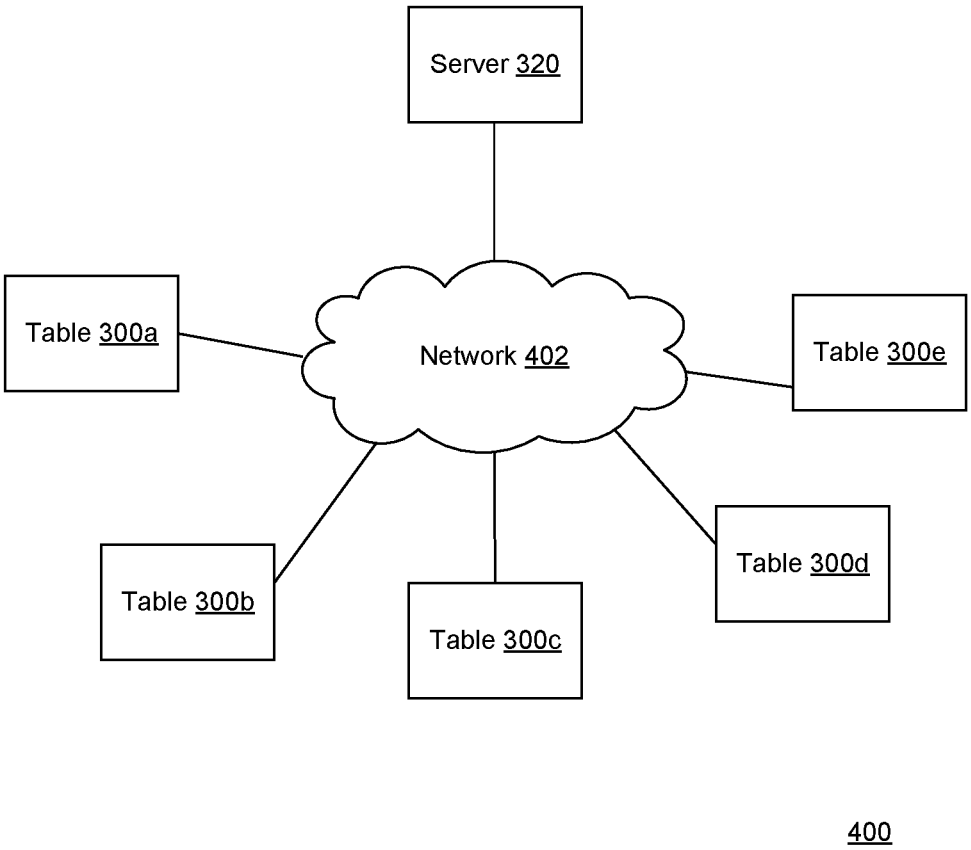
FIG. 4 is a block diagram of a gaming system 400.

FIG. 4 is a block diagram of a gaming system 400. The gaming system 400 includes a number of gaming tables 300 (five shown: 300*a*, 300*b*, 300*c*, 300*d* and 300*e*). The gaming tables 300 are similar to the gaming table 300 shown in FIG. 3. The gaming system 400 includes a server 320, which is similar to the server 320 of FIG. 3. A network 402 connects the gaming tables 300 and the server 320. The network 402 may be a wired network (e.g., Ethernet network, IEEE 802.3 network, etc.) or a wireless network (e.g., wireless local area network, IEEE 802.11 network, etc.). The gaming system 400 may be implemented at a single premises casino location.

Each of the gaming tables 300 may have a different type of game. For example, the gaming table 300*a* offers Baccarat, and the gaming table 300*b* offers Pai Gow Poker. Each of the gaming tables 300 provides its jackpot collections to the server 320, which manages the progressive jackpot total. Thus, the progressive jackpot is available to all of the gaming tables 300, despite that they may offer different games.

Figure 5:
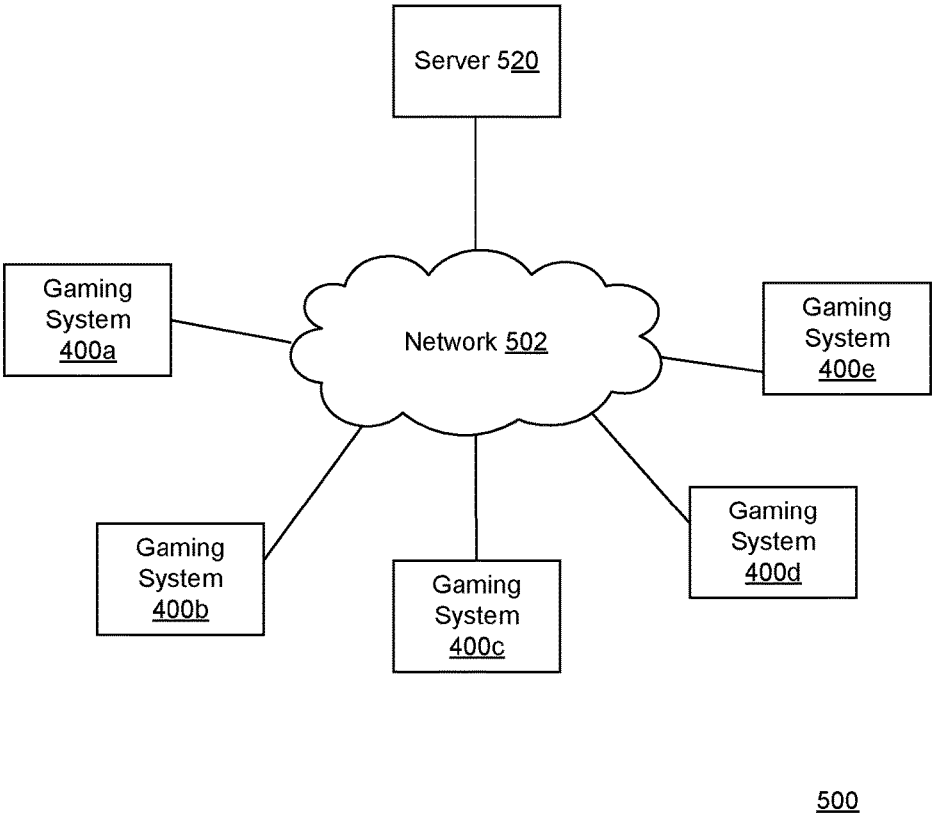
FIG. 5 is a block diagram of a gaming system 500.

FIG. 5 is a block diagram of a gaming system 500. The gaming system 500 includes a server 520 and a number of gaming systems 400 (five shown: 400*a*, 400*b*, 400*c*, 400*d* and 400*e*). The gaming systems 400 are similar to the gaming system 400 shown in FIG. 4; each gaming system 400 corresponds to a different single premises casino location. A network 502 connects the server 520 and the gaming systems 400. The network 502 may be a wired network (e.g., Ethernet network, IEEE 802.3 network, etc.) or a wireless network (e.g., wireless local area network, IEEE 802.11 network, etc.).

The server 520 manages an overall progressive jackpot total. Each of the gaming systems 400 contributes to the progressive jackpot managed by the server 520, and each gaming table at each of the single premises casinos can qualify for winning the overall progressive jackpot. Thus, the progressive jackpot is available to multiple different premises casinos, each of which may offer multiple types of different games.

The server 520 may be located at one of the single premises casinos (e.g., at the casino hosting the gaming system 400*a*).

Figure 6:
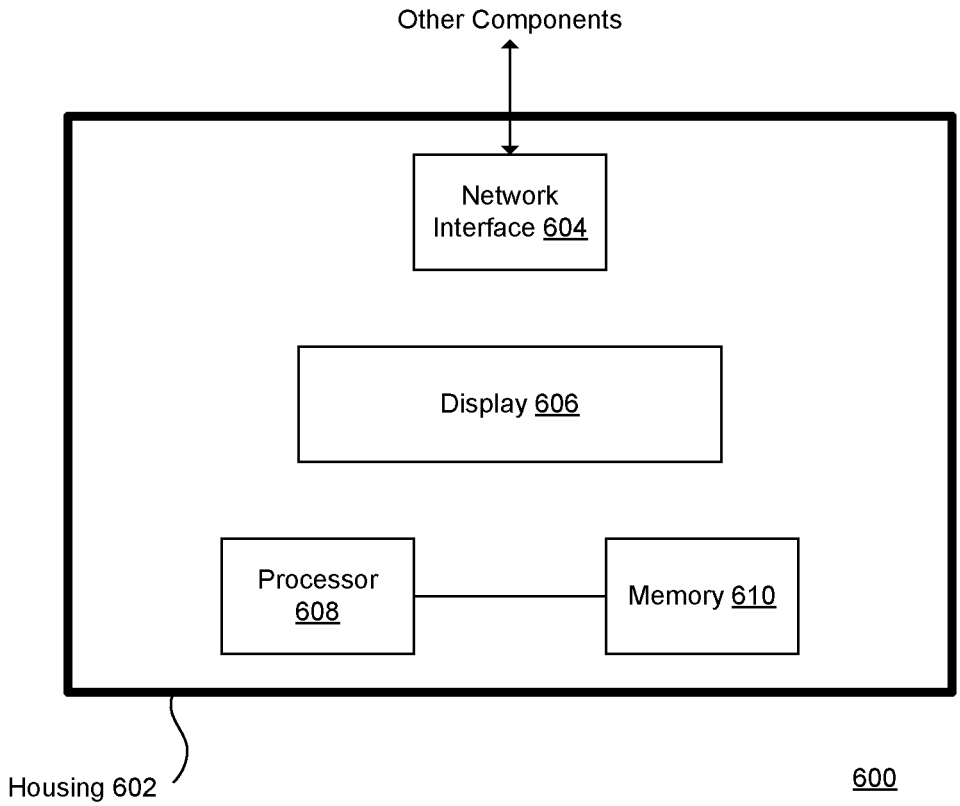
FIG. 6 is a block diagram of the gaming system 600 (see also FIG. 3).

FIG. 6 is a block diagram of the gaming system 600 (see also FIG. 3). The gaming system 600 includes a housing 602, a display device 604, a network interface 606, at least one processor 608, and at least one memory device 610. The gaming system 600 may be associated with a gaming table (e.g., the gaming table 300 of FIG. 3). The gaming system 600 generally manages the progressive jackpot, as described above, for the gaming table.

The housing 602 generally provides structural support and physical containment of the other components of the gaming system 600. The housing 602 may include holes, tabs or other features for attaching the gaming system 600 to the gaming table.

The display device 604 generally displays information related to the gaming system 600. This information may include the current progressive jackpot amount, an indicator that a player has made a jackpot wager, an indicator that the current game has resulted in a jackpot, an indicator of the jackpot amount (for a given game result), etc.

The network interface 606 generally communicates information between the gaming system 600 and other components. For example, the network interface 606 may connect to components shown in FIG. 3 such as the server 320, the collection box 310, the card monitor 312, the chip monitor 314, etc. The network interface 606 may connect to the network 402 (see FIG. 4).

The processor 608 generally controls the operation of the gaming system 600. The processor 608 may execute computer program instructions that control the operation of the gaming system 600.

The memory device 610 generally stores data used by the gaming system 600. The memory device 610 also stores the computer program instructions, executed by the processor 608, that control the operation of the gaming system 600. Further details of the operation of the gaming system 600 are discussed with reference to FIG. 7.

Figure 7:
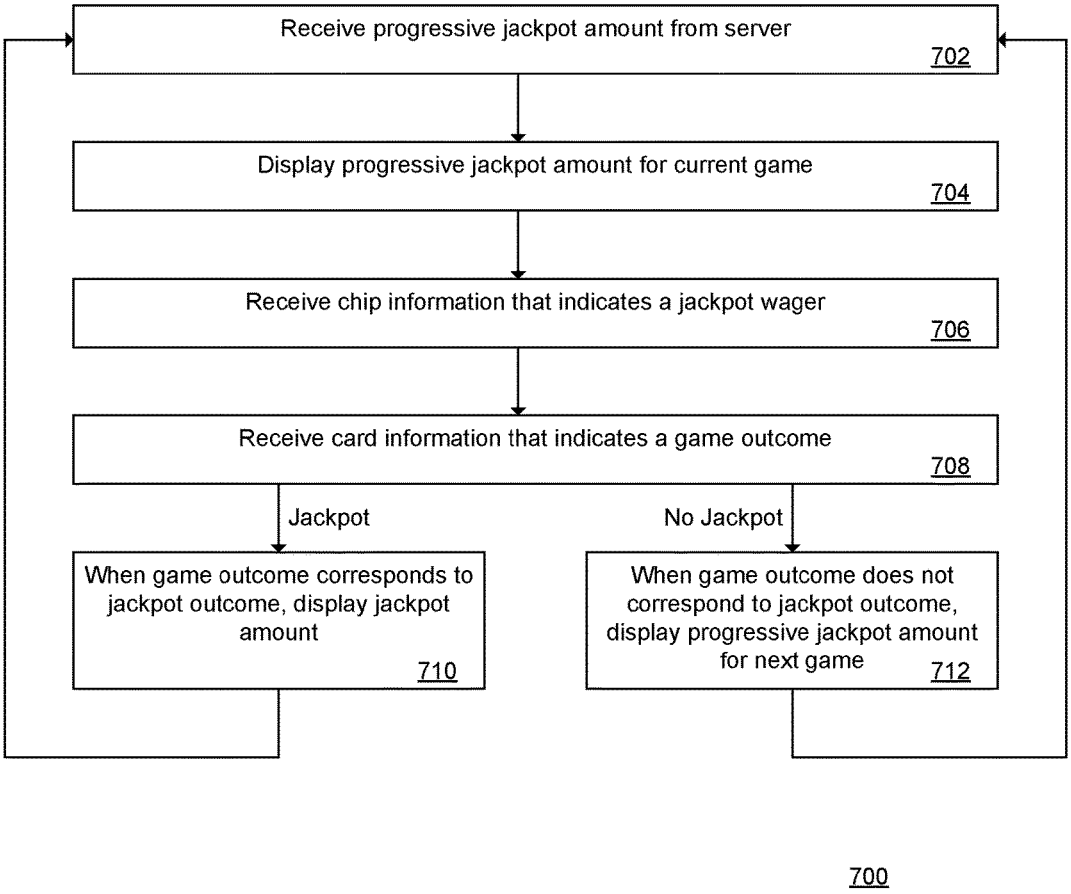
FIG. 7 is a flow diagram of a method 700 that controls the operation of the gaming system 600 (see FIG. 6).

FIG. 7 is a flow diagram of a method 700 that controls the operation of the gaming system 600 (see FIG. 6). The method 700 may be performed by the processor 608 as it executes computer program instructions that correspond to the method 700.

At 702, a progressive jackpot amount is received from a server. For example, the server 320 (see FIG. 3) may send the progressive jackpot amount to the gaming system 600. The progressive jackpot amount is associated with a plurality of gaming systems that includes the gaming system 600. For example, the gaming system 600 may be associated with the gaming table 300*a* (see FIG. 4), and multiple other gaming systems may be associated with the gaming tables 300*b*, 300*c*, 300*d*, etc.

At 704, the progressive jackpot amount is displayed for a current game. For example, before a game starts at the gaming table 300, the gaming system 600 may display the progressive jackpot amount, so that players at the gaming table 300 can make a jackpot wager.

At 706, chip information is received. The chip information indicates a jackpot wager for the current game. For example, a player may make a jackpot wager by placing a chip at the jackpot wagering area on the gaming table 300; the chip monitor 314 detects the chip and communicates this information to the gaming system 600.

In addition, the server updates the progressive jackpot amount according to the jackpot wager. For example, when the current game does not result in a jackpot, the dealer moves the chip of the losing jackpot wager into the collection box 310; this is detected by the chip monitor 314; the gaming system 600 communicates the losing jackpot wager amount to the server 320; and the server 320 updates the progressive jackpot amount.

The server 320 and gaming system 600 may communicate to update the progressive jackpot amount continuously. For example, at the start of a game at gaming table 300*a* (see FIG. 4), the jackpot total is $46,000, and one player makes a jackpot wager of $1; at the end of the game, the losing jackpot wager is collected, and the gaming system 600 at the gaming table 300*a* communicates this information to the server 320; the new jackpot total is $46,001, which the server 320 communicates to the gaming tables of FIG. 4 (e.g., 300*a*, 300*b*, etc.). Alternatively, the server 320 and gaming system 600 may communicate to update the progressive jackpot amount on an intermittent basis. For example, every 10 minutes the gaming system 600 communicates to the server 320 the amount of losing jackpot wagers it has collected; or every 10 minutes the server 320 updates the jackpot amount and communicates the updated amount to the gaming tables of FIG. 4.

At 708, card information is received. The card information indicates a game outcome of the current game. For example, the card monitor 312 (see FIG. 3) detects the game outcome and communicates this information to the gaming system 600. As another example, in Blackjack the card monitor 312 is able to detect that the dealer's hand is 8-8-8 (see TABLE 1), and communicates this information to the gaming system.

At 710, when the game outcome corresponds to a jackpot outcome, a jackpot amount is displayed. The gaming system 600 may determine that the jackpot outcome exists by comparing the game outcome with jackpot rules (e.g., corresponding to the information in TABLE 1, TABLE 2 or TABLE 3, etc.) stored by the memory device 610. The gaming system 600 may determine the jackpot amount by retrieving the jackpot amount associated with the rule for the winning game outcome (e.g., corresponding to the information in TABLE 1, TABLE 2 or TABLE 3, etc.). The display 606 may display the jackpot amount.

Once the jackpot has occurred, the server 320 reduces the progressive jackpot amount by the jackpot amount. For example, the gaming system 600 may communicate to the server 320 that the jackpot has been paid, and the server 320 correspondingly reduces the progressive jackpot amount.

When 710 is complete, the process then returns to 702.

At 712, when the game outcome does not correspond to the jackpot outcome, the progressive jackpot amount for a next game is displayed. The process then returns to 702.

Special Purpose Gaming Devices

Some gaming machines according to embodiments are implemented with special features or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

For example, a watchdog timer may be used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines may have power supplies with tighter voltage margins than that required by the operating circuitry. In addition, the voltage monitoring circuitry may typically have two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for gaming machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., balance) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines is that they often include unique interfaces, including serial interfaces, to connect to specific subsystems internal and external to the gaming machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the gaming machine, serial devices may be connected in a shared, daisy-chain fashion where multiple peripheral devices are connected to a single serial channel.

The serial interfaces may be used to transmit information using communication protocols that are unique to the gaming industry. As an example, SAS or Super-SAS are communication protocols used to transmit information, such as metering information, from a gaming machine to a remote device. Often SAS or Super-SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, e.g., via software for reading status registers. This can trigger event log entries and further data authentication operations by the gaming machine software.

Trusted memory devices or trusted memory sources are preferably included in a gaming machine computer to ensure the authenticity of the software that may be stored on less secure memory subsystems, such as mass storage devices. In particular embodiments, a JAM (Java Access Module) card in a gaming machine may treat information received from the master gaming controller as not trusted as it may be unaware that the gaming machine includes a trusted memory device. The JAM cards may be used to authenticate the portable card devices described herein.

Trusted memory devices and controlling circuitry are typically designed to not allow modification of the code and data stored in the memory device while the memory device is installed in the gaming machine. The code and data stored in these devices may include authentication algorithms, random number generators, authentication keys, operating system kernels, etc. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of the verification algorithms included in the trusted device, the gaming machine is allowed to verify the authenticity of additional code and data that may be located in the gaming computer assembly, such as code and data stored on hard disk drives.

In at least one embodiment, at least a portion of the trusted memory devices/sources may correspond to memory which cannot easily be altered (e.g., "unalterable memory") such as, for example, EPROMS, PROMS, Bios, Extended Bios, and/or other memory sources which are able to be configured, verified, and/or authenticated (e.g., for authenticity) in a secure and controlled manner.

According to a specific implementation, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment of the present invention, the remote device and the trusted information source may engage in methods using zero knowledge proofs to authenticate each of their respective identities.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

As will be appreciated by one skilled in the art, aspects of embodiments may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "circuit", "module" or "system". Furthermore, aspects may take the form of a computer program product embodied in one or more computer readable medium(s) having computer readable program code embodied thereon.

Any combination of one or more computer readable media may be used. The computer readable medium may be a computer readable signal medium or a computer readable storage medium that is non-transitory. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

Program code embodied on a computer readable medium may be transmitted using any appropriate medium, including but not limited to wireless, wired, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "CC programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects have been described above with reference to flowchart illustrations and/or block diagrams of methods, apparatus (systems) and computer program products according to embodiments. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that may direct a computer, other programmable data processing apparatus, or other devices to function in a particular manner, such that the instructions stored in the computer readable medium produce an article of manufacture including instructions which implement the function/act specified in the flowchart or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the above figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

What is claimed is:

1. A gaming system, comprising:

a housing;

a display device;

a network interface;

at least one processor; and at least one memory device that stores a plurality of instructions that, when executed by the at least one processor, cause the at least one processor to operate with the display device and the network interface to:

receive, from a server, a progressive jackpot amount, wherein the progressive jackpot amount is associated with a plurality of gaming systems that includes the gaming system, display the progressive jackpot amount for a current game, receive chip information that indicates a jackpot wager for the current game, wherein the server updates the progressive jackpot amount according to the jackpot wager, receive card information that indicates a game outcome of the current game, when the game outcome corresponds to a jackpot outcome, display a jackpot amount, wherein the server reduces the progressive jackpot amount by the jackpot amount, and when the game outcome does not correspond to the jackpot outcome, display the progressive jackpot amount for a next game, further comprising:

a gaming table;

a radio frequency identification (RFID) chip reader that that generates the chip information by detecting gaming chips being collected into a collection box, wherein the gaming system transmits the chip information to the server; and an instrumented card shoe that generates the card information by detecting gaming cards removed from the instrumented card shoe, wherein the gaming cards are played on the gaming table, wherein the at least one processor is further configured to implement a Baccarat game, wherein for the Baccarat game, the jackpot outcome is one of a first jackpot outcome and a second jackpot outcome, and wherein the jackpot amount is one of a first jackpot amount and a second jackpot amount;

wherein the first jackpot outcome is a three-card win by a banker with a point total of 7 and the banker and a player have all red cards, and the first jackpot amount is $1000; and wherein the second jackpot outcome is the three-card win by the banker with the point total of 7 and the banker and the player have all diamond cards, and the second jackpot amount is all of the progressive jackpot amount.

2. The gaming system of claim 1, wherein the RFID chip reader generates additional chip information by detecting the gaming chips on the gaming table, wherein the gaming system transmits the additional chip information to the server.

3. The gaming system of claim 1, wherein the plurality of gaming systems are associated with a plurality of gaming tables, wherein the progressive jackpot amount is collected from the plurality of gaming tables.

4. The gaming system of claim 1, wherein the plurality of gaming systems are associated with a plurality of gaming tables, wherein the plurality of gaming tables are associated with at least two types of casino games.

5. The gaming system of claim 1, wherein the at least one memory device stores a plurality of jackpot outcomes that includes the jackpot outcome.

6. The gaming system of claim 1, wherein the at least one memory device stores a plurality of jackpot outcomes for a plurality of casino games.

7. A progressive jackpot system, comprising:

a server; and a plurality of gaming systems, wherein each gaming system has a housing, a display device, a network interface, at least one processor, and at least one memory device, wherein the at least one memory device stores a plurality of instructions that, when executed by the at least one processor, cause the at least one processor to operate with the display device and the network interface to:

receive, from the server, a progressive jackpot amount, wherein the progressive jackpot amount is associated with the plurality of gaming systems, display the progressive jackpot amount for a current game, receive chip information that indicates a jackpot wager for the current game, wherein the server updates the progressive jackpot amount according to the jackpot wager, receive card information that indicates a game outcome of the current game, when the game outcome corresponds to a jackpot outcome, display a jackpot amount, wherein the server reduces the progressive jackpot amount by the jackpot amount, and when the game outcome does not correspond to the jackpot outcome, display the progressive jackpot amount for a next game, wherein each gaming system further comprises:

a gaming table;

a radio frequency identification (RFID) chip reader that that generates the chip information by detecting gaming chips being collected into a collection box, wherein the gaming system transmits the chip information to the server; and an instrumented card shoe that generates the card information by detecting gaming cards removed from the instrumented card shoe, wherein the gaming cards are played on the gaming table, wherein the at least one processor is further configured to implement a Baccarat game, wherein for the Baccarat game, the jackpot outcome is one of a first jackpot outcome and a second jackpot outcome, and wherein the jackpot amount is one of a first jackpot amount and a second jackpot amount;

wherein the first jackpot outcome is a three-card win by a banker with a point total of 7 and the banker and a player have all red cards, and the first jackpot amount is $1000; and wherein the second jackpot outcome is the three-card win by the banker with the point total of 7 and the banker and the player have all diamond cards, and the second jackpot amount is all of the progressive jackpot amount.

8. The progressive jackpot system of claim 7, wherein the server updates the progressive jackpot amount according to the jackpot wager from each of the plurality of gaming systems.

9. The progressive jackpot system of claim 7, wherein the plurality of gaming systems are associated with a plurality of gaming tables, wherein the progressive jackpot amount is collected from the plurality of gaming tables.

10. The progressive jackpot system of claim 7, wherein the plurality of gaming systems are associated with a plurality of gaming tables, wherein the plurality of gaming tables are associated with at least two types of casino games.

11. A method of managing a progressive jackpot, comprising:

providing a gaming system having a housing, a display device, a network interface, at least one processor, and at least one memory device, wherein the at least one memory device stores a plurality of instructions that, when executed by the at least one processor, cause the at least one processor to operate with the display device and the network interface;

receiving, by the gaming system from a server, a progressive jackpot amount, wherein the progressive jackpot amount is associated with a plurality of gaming systems that includes the gaming system;

displaying, by the gaming system, the progressive jackpot amount for a current game;

receiving, by the gaming system, chip information that indicates a jackpot wager for the current game, wherein the server updates the progressive jackpot amount according to the jackpot wager;

receiving, by the gaming system, card information that indicates a game outcome of the current game;

when the game outcome corresponds to a jackpot outcome, displaying a jackpot amount, wherein the server reduces the progressive jackpot amount by the jackpot amount; and when the game outcome does not correspond to the jackpot outcome, displaying the progressive jackpot amount for a next game, wherein the gaming system further comprises:

a gaming table;

a radio frequency identification (RFID) chip reader that that generates the chip information by detecting gaming chips being collected into a collection box, wherein the gaming system transmits the chip information to the server; and an instrumented card shoe that generates the card information by detecting gaming cards removed from the instrumented card shoe, wherein the gaming cards are played on the gaming table, wherein for a Baccarat game, the jackpot outcome is one of a first jackpot outcome and a second jackpot outcome, and wherein the jackpot amount is one of a first jackpot amount and a second jackpot amount;

wherein the first jackpot outcome is a three-card win by a banker with a point total of 7 and the banker and a player have all red cards, and the first jackpot amount is $1000; and wherein the second jackpot outcome is the three-card win by the banker with the point total of 7 and the banker and the player have all diamond cards, and the second jackpot amount is all of the progressive jackpot amount.

12. The gaming system of claim 1, wherein the server updates the progressive jackpot amount in real time according to the chip information indicative of the jackpot wager.

13. The gaming system of claim 1, wherein the server updates the progressive jackpot amount on an intermittent basis.

14. The gaming system of claim 1, wherein the server communicates the progressive jackpot amount to the gaming system on an intermittent basis.

* * * * *